United States Patent [19]

Beg

[11] Patent Number: 4,724,374

[45] Date of Patent: Feb. 9, 1988

[54] SOLID STATE CURRENT LIMITED POWER CONTROLLER FOR DC CIRCUITS

[75] Inventor: Mirza A. Beg, Lima, Ohio

[73] Assignee: Westinghouse Electric Corp., Pittsburgh, Pa.

[21] Appl. No.: 12,776

[22] Filed: Feb. 9, 1987

[51] Int. Cl.[4] ..... G05F 1/59

[52] U.S. Cl. ..... 323/272; 323/908

[58] Field of Search ..... 323/272, 350, 908

[56] References Cited

U.S. PATENT DOCUMENTS

| | | | |
|---|---|---|---|
| 3,697,860 | 10/1972 | Baker | 323/271 |
| 3,793,580 | 2/1974 | Baker | 323/271 |
| 4,426,615 | 1/1984 | Hannas | 323/272 |

*Primary Examiner*—Patrick R. Salce

*Assistant Examiner*—Jeffrey Sterrett

*Attorney, Agent, or Firm*—R. P. Lenart

[57] ABSTRACT

A solid state switching circuit is provided with a first power sharing circuit which incorporates resistive power dissipation elements so that the required dissipated power is shared between a main power transistor and the power sharing circuit. A second power sharing circuit is connected in parallel with a portion of the first power sharing circuit and operates to provide additional resistive power dissipation under certain switch voltage conditions. The use of this second power sharing circuit permits an increase in the required trip time of the main switching transistor or improves the reliability of the power transistors in the main circuit and the first power sharing circuit by lowering transistor stress during transient conditions.

5 Claims, 5 Drawing Figures

SOLID STATE CURRENT LIMITED POWER CONTROLLER FOR DC CIRCUITS

BACKGROUND OF THE INVENTION

This invention relates to electrical switching circuits and more particularly to solid state switching circuits for controlling DC power in electrical systems.

Solid state switches are of interest for use in aircraft power systems as well as other applications to secure the recognized advantages of solid state components over electromechanical circuit breaker devices. One basic function of such switches is to serve as a remote power controller; that is, to permit switching of the power to a load from a remote location. DC remote power controllers use controlled current limiting to eliminate transient inrush currents, thereby protecting the load and associated wiring from high fault currents. If a fault, and consequently the current limiting condition, persists for a predetermined length of time, a trip circuit within the remote power controller will trip and latch off the associated solid state switching device. Then the load and fault is disconnected from the power system bus and will remain disconnected until the remote power controller is reset.

During the current limiting period, the static switch within the remote power controller must dissipate a power level equal to the switch voltage drop times the load current. The maximum power to be dissipated by the remote power controller occurs with a zero impedance load, that is, a shorted load or grounded wiring. For a typical 150±20 volt DC system with a 5 amp current limit, the power dissipated in the solid state switch could be as high as 850 watts under normal input voltage conditions. During system voltage transient conditions, the instantaneous peak power dissipation can exceed this level.

Since available power transistors are not capable of withstanding the severe current limiting requirements, circuits have been developed to divert part of the current from the power transistor to power resistors. These helper circuits ensure that during the current switching and limiting operation of the remote power controller, the switching transistor remains in its safe operating area.

One remote power controller with a power sharing circuit portion is disclosed in U.S. Pat. No. 3,697,860, issued to D. E. Baker on Oct. 10, 1972 and assigned to the same assignee as the present invention. That patent discloses a remote power controller having a main switching transistor which is normally driven to a near saturation condition in response to an ON command. The level of load current is sensed by a resistive shunt and compared to a fixed reference value. If the load current tries to exceed the reference, the base drive of the switching transistor is adjusted in a closed loop fashion to maintain constant load current. During current limiting, the voltage across the switching transistor increases as the load impedance decreases. A power sharing circuit is connected in parallel with the main switching transistor to perform part of the required power dissipation, thus permitting the use of smaller and lower cost power transistors. The dissipation resistor can be optimized so that both the main switching transistor and a transistor in the power sharing circuit are operated with approximately the same safety margin with respect to their safe operating area second breakdown regions. The disclosure of U.S. Pat. No. 3,697,860 is hereby incorporated by reference.

SUMMARY OF THE INVENTION

The present invention seeks to improve the safety margin of the operating profile of the main switching transistor and a switching transistor in the power sharing circuit by adding an additional power sharing circuit which does not contain an additional expensive power transistor.

A direct current switching circuit constructed in accordance with the present invention includes a first solid state switching device having first and second electrodes, connected in a first circuit branch between a DC power source and a load to be supplied by the source, and a third control electrode. A drive circuit is provided to drive the first device to a conduction level determined by the load current, in response to an ON command signal. A first power sharing circuit is connected in parallel with the first switching device between the power source and the load. This circuit includes a second circuit branch which has a second solid state switching device and a series-connected resistive element. A second drive circuit is provided to maintain the second switching device in a saturated, fully conductive condition when the voltage across the first switching device is below a first predetermined level and to bring the second device out of saturation above that first voltage level. The first power sharing circuit operates to dissipate power at a first low level while voltage across the first switching device is below the first predetermined voltage level and to dissipate power at a second higher level when voltage across the first switching device is above the first predetermined voltage level. A second power sharing circuit which includes a third circuit branch is electrically connected in parallel with at least a portion of the second circuit branch. The third circuit branch includes the series connection of a second resistor and a third solid state switching device. Means is provided for turning on the third solid state switching device when the voltage across the first switching device is below a second predetermined level and for turning off the third solid state switching device when the voltage across the first switching device is above the second predetermined level.

By adding the second power sharing circuit the safety margins of the operating characteristics of the first and second switching devices are increased to improve the reliability of these devices and to increase the allowable trip time of the remote power controller. These improvements are accomplished without the use of an additional expensive power transistor.

DESCRIPTION OF THE PREFERRED EMBODIMENT

Figure 1:
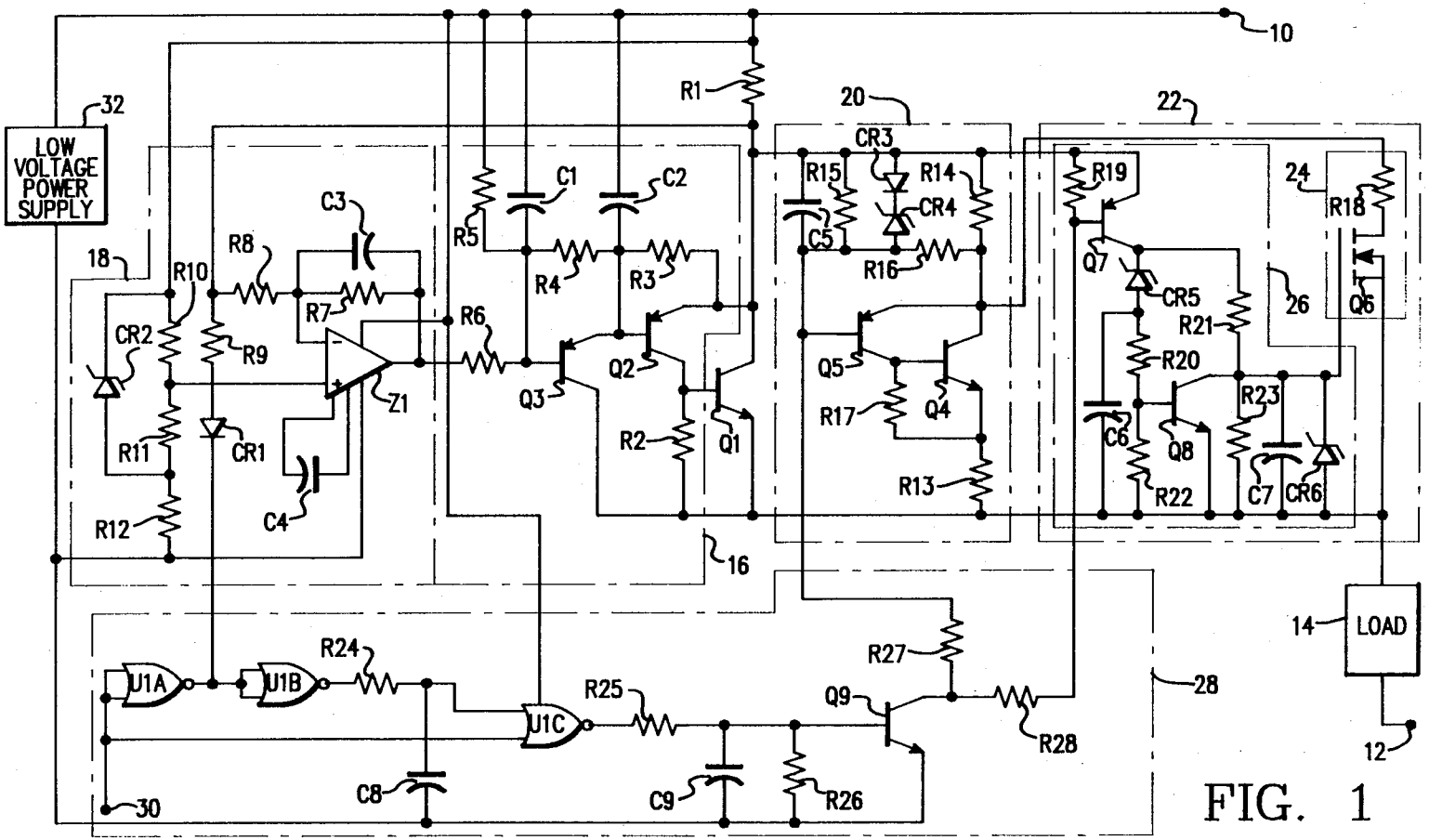
FIG. 1 is a schematic drawing of one embodiment of the present invention.

Referring to the drawings, FIG. 1 is a schematic diagram of a remote power controller constructed in accordance with one embodiment of the present invention. This power controller includes terminals 10 and 12 for connection to an external DC power source which may be, for example, 150±20 volts DC. The power controller includes a first solid state switching and amplifying device in the form of transistor Q1, which includes a main conduction path, between its collector and emitter, which is connected in a first circuit branch through a resistive shunt R1 between the external DC power source connected to terminal 10 and a load 14. The base of transistor Q1 is driven by a drive circuit 16 which comprises transistors Q2 and Q3, resistors R2, R3, R4, R5 and R6, and capacitors C1 and C2. This drive circuit operates in accordance with the prior art to drive transistor Q1 to a conduction level which is determined by the load current flowing from the external power source. A current limiting circuit 18 senses the voltage across resistive shunt R1 and thereby monitors the current flowing to the load. When excessive current is sensed, this circuit causes transistor Q1 to operate in a current limiting fashion. The current limiting circuit 18 comprises operational amplifier Z1, diodes CR1 and CR2, capacitors C3 and C4, and resistors R7, R8, R9, R10, R11 and R12.

A first power sharing circuit 20 has a circuit branch which includes the series connection of transistor Q4 and resistor R13 with the impedance of resistor R13 being substantially greater than the impedance of any resistive element in the first circuit branch. The second circuit branch, which also includes resistor R14, is electrically connected in parallel with the main switching transistor Q1. Transistor Q5, capacitor C5, diodes CR3 and CR4, and resistors R15, R16, and R17 comprise a drive circuit for transistor Q4 which controls the conduction level of transistor Q4 such that resistor R13 dissipates power at a first low level while voltage across transistor Q1 is below a first predetermined level and resistor R13 dissipates power at a second higher level when the voltage across transistor Q1 is above the first predetermined level. This is accomplished by holding transistor Q4 in a saturated, fully conductive condition when the voltage across transistor Q1 is below the first predetermined level and to bring transistor Q4 out of saturation when the voltage across Q1 is above the predetermined level. A second power sharing circuit 22 includes a third circuit branch 24 which comprises the series-connection of resistor R18 and field effect transistor Q6. This third circuit branch is electrically connected in parallel with that portion of the second circuit branch which includes transistor Q4 and resistor R13. The second power sharing circuit also includes a drive circuit 26 which is electrically connected across switching transistor Q1 and serves as means for turning on transistor Q6 when the voltage across transistor Q1 is below a second predetermined level and for turning off transistor Q6 when the voltage across transistor Q1 is above the second predetermined level. Drive circuit 26 comprises transistors Q7 and Q8, diodes CR5 and CR6, capacitors C6 and C7, and resistors R19, R20, R21, R22 and R23.

A logic control circuit 28 is connected to drive circuit 16 and the drive circuits in the two power sharing networks 20 and 22 and serves as means for enabling the circuits in response to an ON or a TRIP signal on input terminal 30. This logic control circuit comprises NOR gates U1A, U1B and U1C, capacitors C8 and C9, transistor Q9 and resistors R24, R25, R26, R27 and R28.

A low voltage power supply 32 produces the required logic level voltages, for example ±15 volts DC, for the current limiting and control circuits.

The curves of FIG. 2 can now be used to illustrate the operating characteristics of the main switching transistor Q1 and the power transistor Q4 in the first power sharing circuit 20 of FIG. 1. The safe operating area for the associated power transistors is the region below curve 34 for DC conditions and below curve 36 for a 100 millisecond time period. In other words, failure of the power transistors occurs above curve 34 under DC conditions and above curve 36 if the transistors are operated in this region for longer than 100 milliseconds. FIG. 2A illustrates operating profiles for a prior art remote power controller which is similar to the circuit of FIG. 1 but does not contain the second power sharing circuit 22 and the associated connecting circuitry. These curves are included to show a typical remote power controller design characteristic wherein the operating profile of the main switching transistor which corresponds to transistor Q1 in FIG. 1 is illustrated by curve 38 and the operating profile of the power transistor in the power sharing network, which corresponds to transistor Q4 in FIG. 1, is illustrated by curve 40. Both extend beyond the safe operating area defined by curve 34 for DC conditions. It should be apparent from the curves of FIG. 2 that the remote power controller must trip in a time period which is less than 100 milliseconds to avoid failure of the power transistors.

Figure 2A:
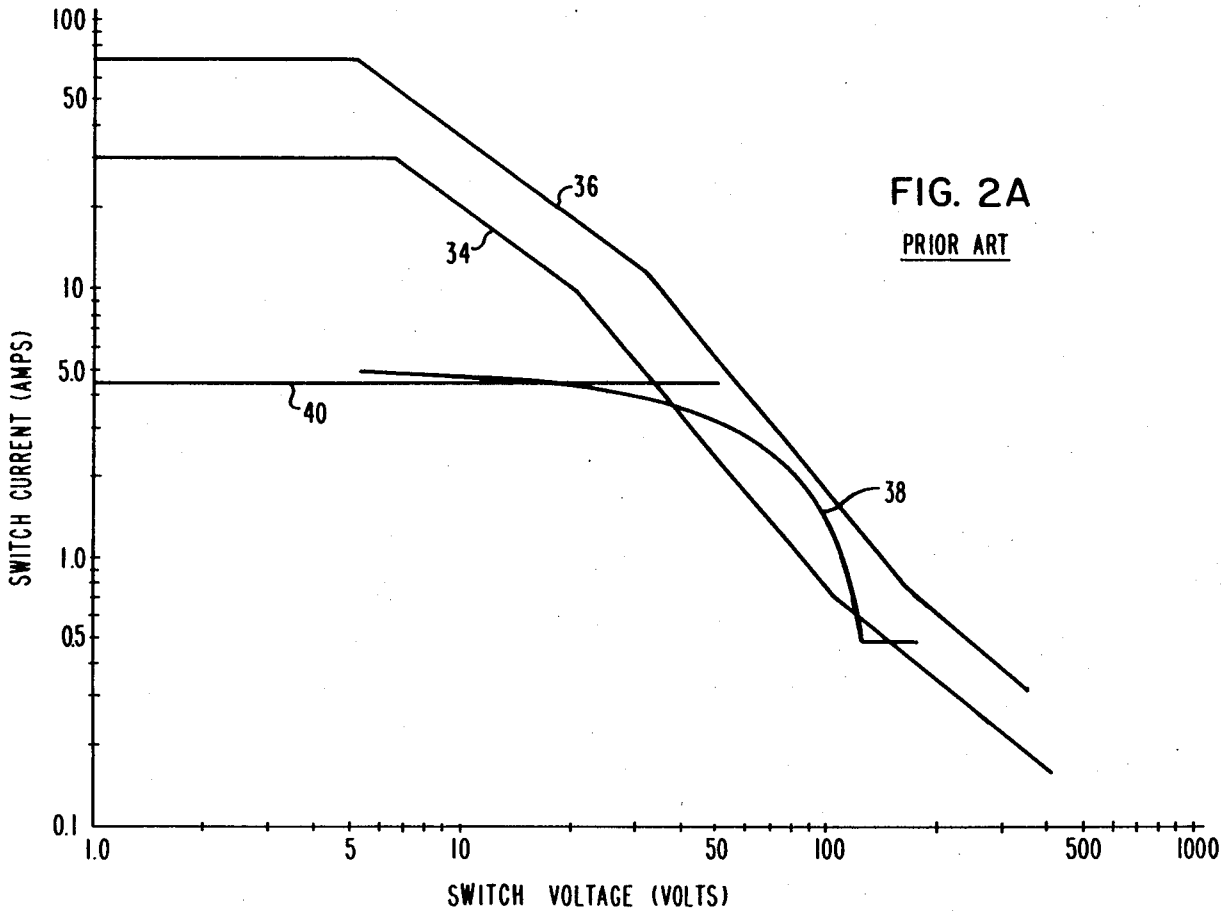
FIG. 2A PRIOR ART
FIG. 2A includes operating curves for the main switching transistor and power sharing transistor in a prior art remote power controller.
Figure 2B:
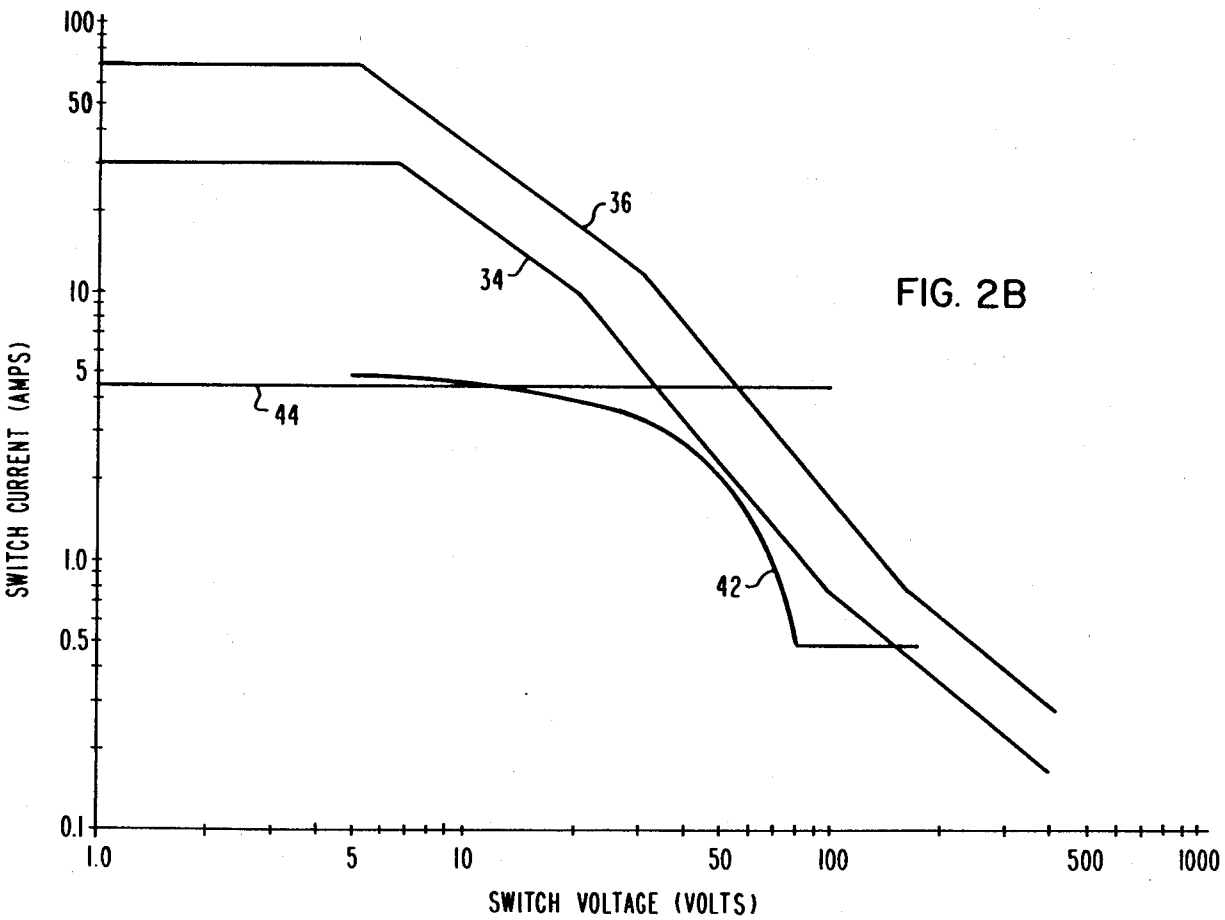
FIGS. 2B and 2C show curves which illustrate the effects of changing component values in the first power sharing circuit of the circuit of FIG. 1.

The curves of FIG. 2B illustrate the effect of changing the value of the resistor corresponding to resistor R13 in prior art power controllers. For example, if the resistor corresponding to resistor R13 is 15.4 ohms, the operating profile of the main switching transistor corresponding to transistor Q1, as illustrated by curve 42 lies within the safe operating area for DC conditions defined by curve 34. However, the operating profile for the power transistor in the power sharing circuit (corresponding to transistor Q4 in FIG. 1) as defined by curve 44 extends beyond the safe operating areas defined by both the DC curve 34 and the 100 millisecond curve 36.

Figure 2C:
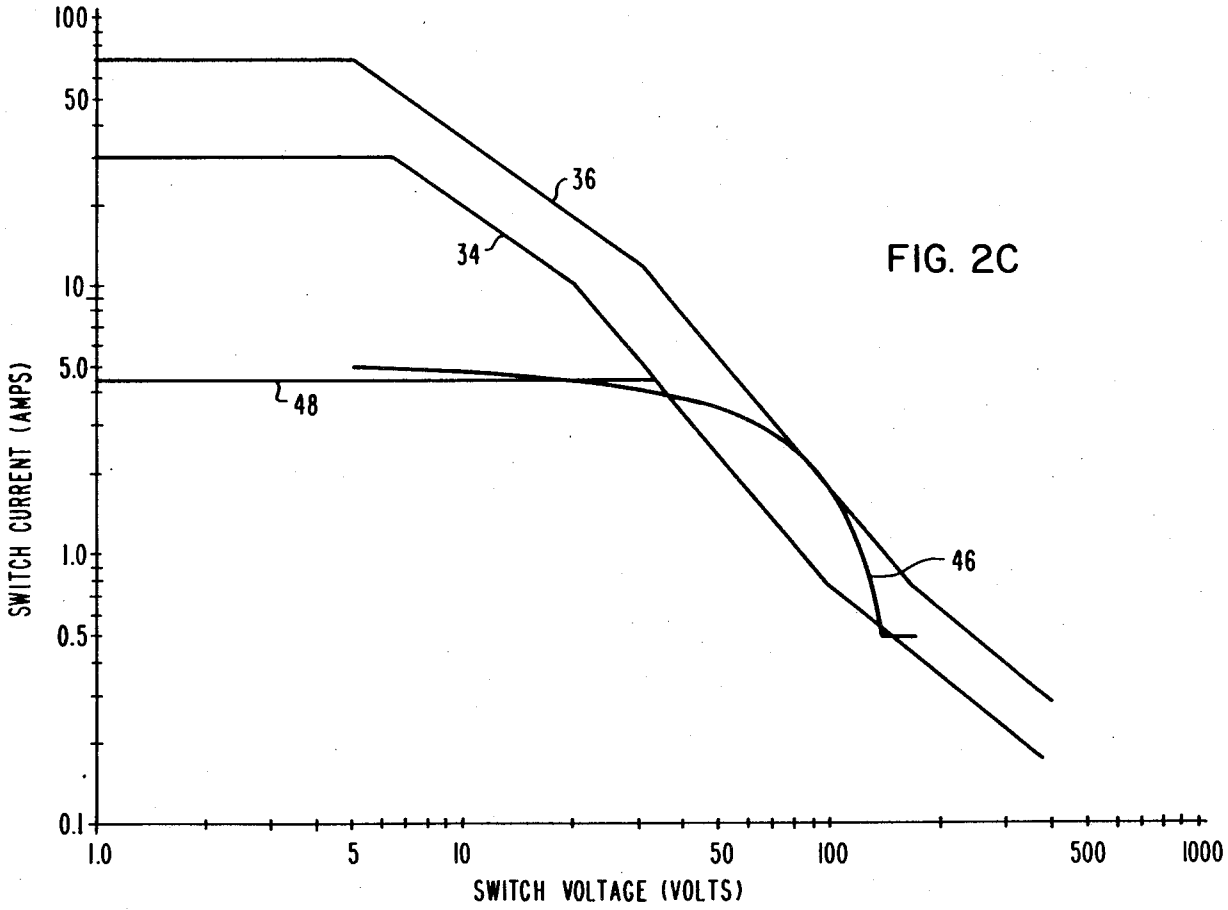

The curves of FIG. 2C illustrate the effect of increasing the resistance of the power sharing resistor (corresponding to resistor R13 in FIG. 1). If the resistance is increased to, for example, 29.1 ohms, the operating profile for the main switching transistor as defined by curve 46 includes a portion which lies on the 100 millisecond second breakdown part of curve 36 and the operating profile for the power sharing transistor as illustrated by curve 48 lies within the safe operating area defined by curve 34 for DC conditions.

It is clear from the curves of FIGS. 2B and 2C that altering the resistance of the power sharing resistor produces conflicting results with respect to the resulting changes in the operating profiles of the main power transistor and the power sharing transistor. Therefore, the present invention overcomes this problem by adding a second power sharing circuit 22 in FIG. 1. By using this second power sharing circuit, remote power controller trip times of greater than 100 milliseconds can be employed and/or greater safety margins between the second breakdown region of the safe operating area curves and the operating profiles of the power transistors can be achieved.

The circuit of the present invention acts to bring the operating profiles of the power transistors within the DC safe operating area without the use of an additional expensive power transistor. This is accomplished by adding a second power sharing circuit which acts to effectively change the equivalent value of the first power sharing circuit dissipation resistor as the voltage across the main switching transistor varies.

Figure 2D:
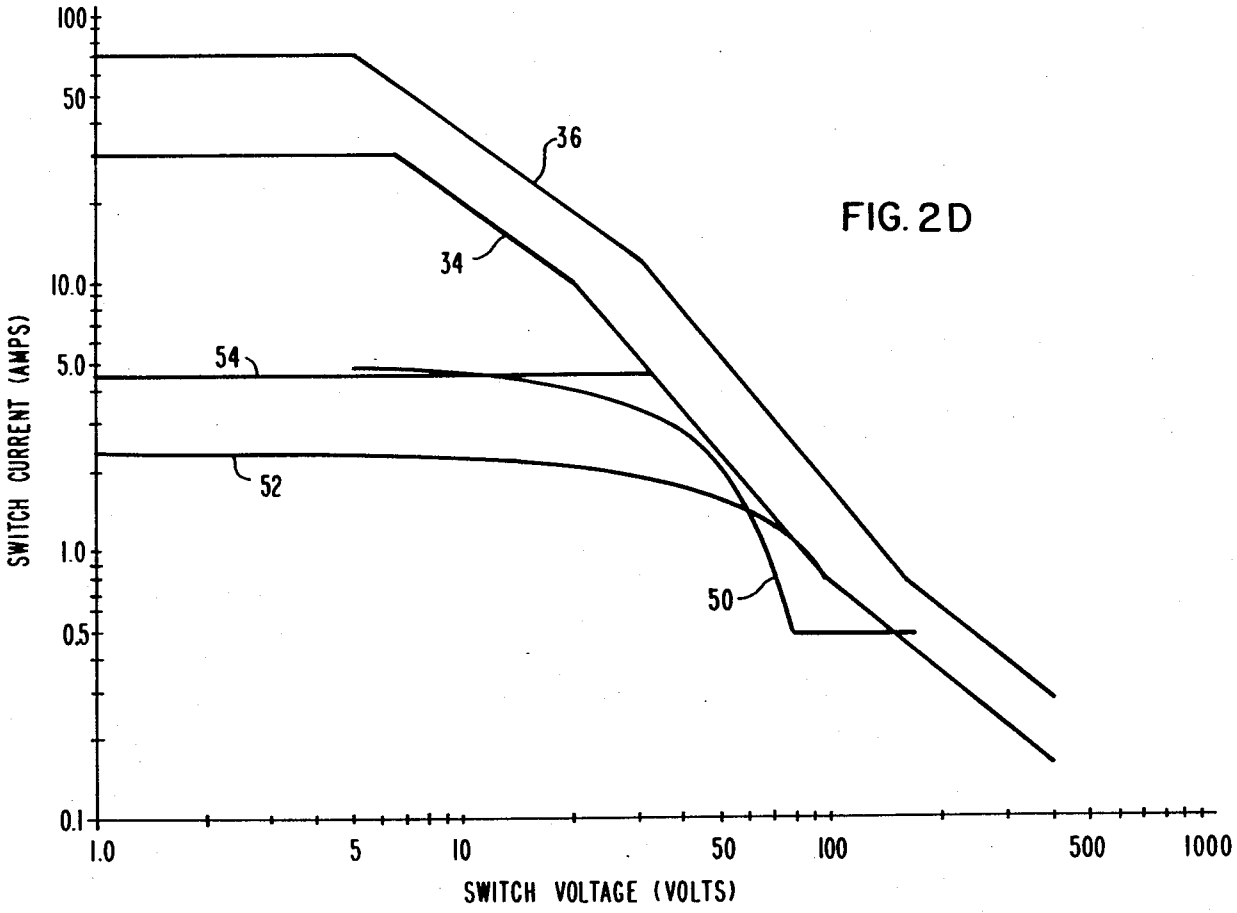
FIG. 2D shows operating curves for the power transistors of the circuit of FIG. 1.

In the circuit of FIG. 1, an ON command on terminal 30 turns on transistors Q1, Q4 and Q6. The voltage across the main switching transistor Q1 increases as the system tries to regulate the load current to a preset maximum overload level of, for example 5 amperes. The current through the main conduction path of transistor Q4 increases as the voltage across transistor Q1 increases to a maximum preset value of, for example, 4.5 amperes. At still higher voltages across transistor switch Q1, transistor Q4 acts as a current source of 4.5 amperes. When the voltage across transistor Q1 increases to the zener voltage of diode CR5, transistor Q8 is turned on, thereby pulling the gate to source voltage of transistor Q6 to zero. Thus, for switch voltages greater than the zener voltage of diode CR5, the second power sharing circuit 22 is isolated from the rest of the remote power controller. The operating profiles for transistors Q1 and Q4 in FIG. 1 are illustrated in FIG. 2D. Curve 50 illustrates that the operating profile of transistor Q1 always remains within the safe operating area defined by curve 34 for DC conditions. Curve 52 illustrates the operating profile for transistor Q4 when the voltage across transistor Q1 is less than the zener voltage of diode CR5. Similarly, curve 54 illustrates the operating profile of transistor Q4 when the voltage across transistor Q1 exceeds the zener voltage of diode CR5. Therefore, it can be seen that under all voltage conditions, the operating profiles of transistors Q1 and Q4 always remain within the safe operating area defined by curve 34 in the second breakdown region for DC conditions.

It should now be apparent that the present invention has improved the safety margins of the power transistors in remote power controllers without the need for an additional expensive power transistor. In order to provide a more complete description of the circuit of FIG. 1, Table I contains a list of components used to construct the circuit of FIG. 1.

TABLE I

Component Specifications For FIG. 1

| Item | Description |
|---|---|
| Q1, Q4 | PT3513 |
| Q2 | MJ6503 |
| Q3, Q7 | MJ4646 |
| Q5 | 2N6422 |
| Q6 | 1RFJ340 |
| Q8 | 2N3439 |
| Q9 | 2N2219 |
| Z1 | LM101A |
| U1 | 4001 |
| CR1, CR3 | 1N647 |
| CR2 | 1.2 V |
| CR4, CR6 | 5.6 V |
| CR5 | 130 V |
| C1, C2 | 2.2 μfd |
| C3 | 560 pfd |
| C4 | 27 pfd |
| C5, C6, C8 | 1.0 μfd |
| C7 | 1.8 μfd |
| C9 | 0.01 μfd |
| R1 | 50 mv at 5A |
| R2, R17 | 15 Ω |
| R3, R27 | 220 Ω |

TABLE I-continued

Component Specifications For FIG. 1

| Item | Description |
|---|---|
| R4, R6, R19, R22 | 1.5K |
| R5 | 4.7K |
| R7 | 10 M |
| R8 | 200 Ω |
| R9 | 68K |
| R10 | 499 Ω |
| R11 | 11.5K |
| R12 | 15K |
| R13 | 29.1 Ω |
| R14 | 1.24 Ω |
| R15, R23 | 3.9K |
| R16, R26 | 510 Ω |
| R18 | 32.4 Ω |
| R20 | 1.8K |
| R21 | 2.0K |
| R24 | 2.7K |
| R25 | 3.0K |
| R28 | 12K |

While the present invention has been described in terms of what is at present believed to be its preferred embodiment, it will be apparent to those skilled in the art that various changes may be made without departing from the scope of the invention. It is therefore intended that the appended claims cover such changes.

I claim:

1. A DC switching circuit comprising:

a first solid state switching and amplifying device having first and second electrodes, connected in a first circuit branch between a DC power source and a load to be supplied by said source, and a third control electrode;

means for driving said first device to a conduction level determined by the load current flowing from said source;

a first power sharing circuit connected in parallel with said first switching device between said power source and said load;

said first power sharing circuit being operative to dissipate power at a first low level while voltage across said first switching device is below a first predetermined level and to dissipate power at a second higher level when voltage across said first switching device is above said first predetermined level;

said first power sharing circuit portion including a second circuit branch electrically connected in parallel with said first circuit and having a second solid state switching and amplifying device connected in series with a first resistive element having a resistive impedance substantially greater than any resistive impedance in series with said first device in said first circuit branch;

means to hold said second device in a saturated, fully conductive condition when the voltage across said first switching device is below said first predetermined level and to bring said second device out of satuation above said first predetermined voltage level;

a second power sharing circuit including a third circuit branch electrically connected in parallel with at least a portion of said second circuit branch, said third circuit branch including the series connection of a second resistor and a third solid state switching device; and means for turning on said third solid state switching device when the voltage across said first switching device is below a second predetermined level and for turning off said third solid state switching device when the voltage across said first switching device is above said second predetermined level.

2. A DC switching circuit as recited in claim 1, wherein:

said second circuit branch further includes an additional resistive element; and said third circuit branch is electrically connected in parallel with the series combination of said second solid state switching device and said first resistive element.

3. A DC switching circuit as recited in claim 1, further comprising:

means for sensing the current conduction level of said first solid state switching device; and wherein said means for driving said first device includes current limiting control means for ensuring that the conduction level of said first device stays below a preselected maximum current.

4. A DC switching circuit as recited in claim 1, wherein said third solid state switching device is a field effect transistor.

5. A DC switching circuit as recited in claim 1, further comprising:

a logic control circuit for enabling said means for driving said first device and said first and second power sharing circuits in response to a command signal.

* * * * *